US007438008B2

(12) United States Patent
Anezaki

(10) Patent No.: US 7,438,008 B2
(45) Date of Patent: Oct. 21, 2008

(54) SEWING MACHINE

(75) Inventor: Tomoaki Anezaki, Kasugai (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 11/608,414

(22) Filed: Dec. 8, 2006

(65) Prior Publication Data

US 2007/0144416 A1 Jun. 28, 2007

(30) Foreign Application Priority Data

Dec. 9, 2005 (JP) ..... 2005-356060

(51) Int. Cl.
*D05B 29/02* (2006.01)
*D05B 29/00* (2006.01)

(52) U.S. Cl. ..... 112/237

(58) Field of Classification Search ..... 112/236, 112/238, 220, 221, 235, 237
See application file for complete search history.

(56) References Cited

U.S. PATENT DOCUMENTS 3,282,237 A * 11/1966 Niekrawietz ..... 112/236
4,292,907 A * 10/1981 Gilbride et al. ..... 112/236
5,590,614 A * 1/1997 Murata et al. ..... 112/237
6,591,769 B1 * 7/2003 Heidtmann et al. ..... 112/237

FOREIGN PATENT DOCUMENTS

JP 5-245278 A 9/1993
JP 9-84981 A 3/1997
JP 2848968 B2 1/1999

* cited by examiner

*Primary Examiner*—Ismael Izaguirre
(74) *Attorney, Agent, or Firm*—Rossi, Kimms & McDowell, LLP.

(57) ABSTRACT

Sewing machine includes a needle bar that is vertically moved to perform a sewing operation, a fabric holder supported on the needle bar in such a manner that the fabric holder is vertically movable relative to the needle bar, and an urging member for normally urging downward the fabric holder on the needle bar. The sewing machine further includes a position restricting member for mechanically restricting a position of the fabric holder to prevent unwanted upward movement of the fabric holder having reached a lower dead point along with the vertical movement of the needle bar.

9 Claims, 12 Drawing Sheets

SEWING MACHINE

BACKGROUND OF THE INVENTION

The present invention relates generally to sewing machines equipped with a fabric holder (i.e., fabric-holding member) vertically movable together with a needle bar, and more particularly to an improved sewing machine which allows a sewing workpiece to be reliably held down by a fabric holder when the fabric holder is located at its lower dead point and also allows the sewing workpiece to be held down by the fabric holder with a constant holding force.

Heretofore, there have been known sewing machines equipped with a fabric holder supported on a needle bar in such a manner that the fabric holder is vertically movable relative to the needle bar that is vertically driven in a reciprocative fashion. The fabric holder is normally biased or urged downward by a coil spring provided on the needle bar so that its abutment portion abuts against a sewing-needle mounting member (so-called "needle clamp") that is provided on the needle bar and also functions as a stopper. The fabric holder is vertically moved together with the needle bar while kept abutting against the sewing-needle mounting member (needle clamp), but, when the fabric holder has reached its lower dead point to hold down a fabric or sewing workpiece, only the needle bar moves with the fabric holder staying at the lower dead point. One example of such a sewing machine is known from Japanese Patent Application Laid-open Publication No. HEI-5-245278 or No. HEI-9-84981. The No. HEI-5-245278 publication discloses a sewing machine where a needle-bar driving shaft (also known as "main machine shaft") is oriented to extend in a left-right horizontal direction of the sewing machine, while the No. HEI-9-84981 publication discloses a sewing machine where a needle-bar driving shaft is oriented to extend in a front-rear horizontal direction of the machine (so-called "arm-type sewing machine").

In the sewing machine disclosed in each of the No. HEI-5-245278 and No. HEI-9-84981 publications, a supporting member for supporting, from below, a predetermined engagement portion of the fabric holder during the downward or descending movement of the fabric holder is provided to lessen a noise sound (collision sound) generated during integral vertical movement of the fabric holder and needle bar; the supporting member is vertically driven in synchronism with the vertical movement of the needle bar. More specifically, the supporting member is reciprocatively driven, in synchronism with the vertical movement of the needle bar, between a lower limit position where the supporting member supports the engagement portion of the descending fabric holder to define the lower dead point of the fabric holder and an upper limit position spaced upward a predetermined distance from the lower limit position. In the descending stroke of the needle bar, the supporting member is driven, downward from the upper limit position to the lower limit position, in an appropriately-controlled manner so as to support the engagement portion of the fabric holder at the lower limit position with a minimized relative-moving-speed difference between the fabric holder and the supporting member; in this way, it is possible to effectively avoid a sound of collision between the engagement portion of the fabric holder and the supporting member when the fabric holder has been stopped at the lower dead point. In the ascending stroke of the needle bar, on the other hand, the supporting member is driven to move upward, during a period before the needle clamp of the needle bar comes immediately below the abutting portion of the fabric holder held at the lower dead point, so that the needle clamp of the needle bar abuts against the abutment portion of the fabric holder with a minimized relative-moving-speed difference between the needle clamp of the needle bar and the abutment portion of the fabric holder; in this way, it is also possible to avoid a sound of collision between the needle clamp and the abutment portion of the fabric holder. Namely, the disclosed sewing machines equipped with the supporting member are constructed to lessen noise sounds generated as the fabric holder moves vertically, by avoiding collision sounds generated during the descending and ascending movement of the fabric holder.

However, the following inconveniences would be encountered by the sewing machines where the fabric holder is vertically moved together with the needle bar via the coil spring provided on the needle bar. First, because the fabric holder is normally urged downward via the coil spring with respect to the needle bar, the holding-down, by the fabric holder, of the sewing workpiece too is effected via the coil spring, and thus, the force with which the sewing workpiece is held down by the fabric holder depends on the intensity of the biasing force of the coil spring. Therefore, the biasing force of the coil spring has to be great enough for the fabric holder to reliably hold down the sewing workpiece, and thus, if the sewing workpiece is leather or other kind of workpiece of a relatively great thickness, the coil spring has to have a very great biasing force. However, if the biasing force of the coil spring is too great, load torque applied to the needle-bar driving shaft (main machine shaft) would increase more than necessary. Particularly, in a case where the sewing machine is, for example, of a multi-head type having a plurality of machine heads, the load torque tends to be very great, which would sometimes adversely influence the sewing.

Second, the biasing force of the coil spring, normally urging the fabric holder downward, would vary in accordance with the up-and-down movement of the needle bar while the fabric holder is located at the lower dead point. FIGS. 13A and 13B are views schematically showing the fabric holder 41 located at its lower dead point in a typical example of the conventionally-know sewing machines equipped with the supporting member. More specifically, FIG. 13A shows a state of the sewing machine immediately after the fabric holder 41 has reached the lower dead point, and FIG. 13B shows a state of the sewing machine when the needle bar is located at its lower dead point. The sewing machine takes the same state as shown in FIG. 13A immediately before the fabric holder 41 is caused to move upward from the lower dead point. Immediately after the fabric holder 41 has reached the lower dead point, the coil spring 43 has not yet been compressed as seen from FIG. 13A, and thus, the biasing force of the spring 43 is relatively weak. However, as the needle bar 3 descends toward its lower dead point, the coil spring 43 is compressed gradually so that the biasing force of the spring 43 increases gradually. The coil spring 43 takes the most-compressed condition and thereby imparts the greatest biasing force when the needle bar 3 has reached its lower dead point. Then, as the needle bar 3 ascends, the coil spring 43 is decompressed so that its biasing force weakens gradually. Namely, the force with which the fabric holder 41 holds down a sewing workpiece varies as the needle bar 3 moves vertically, and thus, the holding, by the fabric holder 41, of the sewing workpiece tends to be unstable.

Further, Japanese Patent Publication No. 2848968 discloses a sewing machine where the needle bar and fabric holder are vertically moved via separate drive mechanisms in order to avoid the above-discussed inconveniences. According to the disclosure of the No. 2848968 patent publication, the fabric holder is provided on the needle bar in such a manner that it is vertically movable relative to the needle bar that is vertically driven in a reciprocative fashion. On a base needle bar provided parallel to the needle bar, there are provided a first elevator member for driving the needle bar and a second elevator member for driving the fabric holder in such a manner that the first and second elevator members are vertically movable. The first and second elevator members are connected to first and second transmission mechanisms, respectively, so that the elevator members are driven to ascend and descend by the respective transmission mechanisms independently of each other interlocked relation to the rotation of the main machine shaft. The first and second elevator members have first and second drive members, respectively, each of which is rotatable about an axis parallel to the base needle bar. The first drive member has an engaging recessed portion engageable with an engagement portion provided on the needle bar, while the second drive member has an engaging recessed portion engageable with an engagement portion provided on the fabric holder. The first and second drive members are each normally held in a predetermined rotational position where the engagement portion of the needle bar or fabric holder engages the recessed portion of the drive member. When the sewing machine is to be brought into a "jump sewing state" where the vertical movement of the needle bar and fabric holder is temporarily stopped, the two drive members are each rotated about the axis to cancel the engagement between its recessed portion and the engagement portion of the needle bar or fabric holder. By thus canceling the engagement, the sewing machine can be brought into the "jump sewing state" where the vertical movement of the elevator members is prevented from being transmitted to the needle bar and fabric holder. Further, the needle bar has a resilient member (or urging member) provided thereon for imparting an upward urging force to each of the needle bar and fabric holder, and, when the sewing machine is in the "jump sewing state", the abutment portions of the needle bar and fabric holder abut against corresponding stoppers so that the needle bar and fabric holder are held at their respective upper dead points.

In the sewing machine disclosed in the No. 2848968 patent publication, where the fabric holder can be vertically moved, via the second elevator member vertically driven by the rotation of the main machine shaft, without hitting any other member, no collision sound is generated, so that noise sounds resulting from the vertical movement of the fabric holder can be reduced. Further, because the fabric holder is vertically moved with its engagement portion engaging the recessed portion of the second drive member, the vertical movement of the fabric holder is limited (i.e., upper and lower limit positions are defined), so that the fabric holder can be prevented from undesirably lifting up when holding down the sewing workpiece.

The sewing machine disclosed in the No. 2848968 patent publication would present the following inconveniences. Namely, in the disclosed sewing machine, where the needle bar and fabric holder are vertically moved via the separate drive mechanisms, both of the needle bar and fabric holder are "jumped" in order to be temporarily deactivated. However, if both of the needle bar and fabric holder are jumped, collision sounds would be generated when the needle bar and fabric holder abut against their respective stoppers to be held at their upper dead points. Because such collision sounds are generated simultaneously by the needle bar and fabric holder, the collision sounds would become extremely great. Particularly, if the sewing machine is of the multi-head type having a plurality of machine heads, the collision sounds would become much greater in correspondence with the number of the machine heads.

SUMMARY OF THE INVENTION

In view of the foregoing, it is an object of the present invention to provide an improved sewing machine which allows the fabric holder to reliably hold down a sewing workpiece with a constant force by means of a fabric holder without excessive load torque being applied to the needle-bar driving shaft (main machine shaft), and which can effectively lessen noise sounds during operation of the machine.

In order to accomplish the above-mentioned object, the present invention provides an improved sewing machine, which comprises a needle bar that is vertically moved to perform a sewing operation; a fabric holder supported on the needle bar in such a manner that the fabric holder is vertically movable relative to the needle bar; an urging member for normally urging downward the fabric holder on the needle bar; and a position restricting member for mechanically restricting a position of the fabric holder to prevent upward movement of the fabric holder having reached a lower dead point along with the vertical movement of the needle bar.

When the fabric holder has not reached the lower dead point, the fabric holder normally urged by the urging member is held in a predetermined position relative to the needle bar and vertically moves together with the needle bar, as in the conventionally-known sewing machines. Further, as in the conventionally-known sewing machines, when the fabric holder has reached the lower dead point, further downward movement of the fabric holder is prevented, and the needle bar moves further downward, against the biasing force of the urging member, so that a sewing needle provided at its distal end pierces a fabric to perform a sewing operation. During that time, an upward lifting force may act on the fabric holder due to the thickness of the fabric or other factor, and thus, some arrangement must be made to prevent unwanted lift-up of the fabric holder. For that purpose, the urging member, employed in the conventionally-known sewing machines, has a biasing force great enough to prevent unwanted lift-up of the fabric holder. Thus, in the conventionally-known sewing machines, great load torque would be applied to the needle bar, and thus, a great driving force sufficient to overcome such great load torque is required, which therefore resulted in a great load on a main machine shaft driving the needle bar. In contrast, the present invention is characterized by provision of the position restricting member in addition to the urging member, in order to avoid such a prior art problem. Namely, when, in the present invention, the fabric holder has reached the lower dead point along with the vertical movement of the needle bar, the position restricting member mechanically restricts the position of the fabric holder to prevent upward movement, from the lower dead point, of the fabric holder, and thus, the present invention can reliably prevent the fabric holder from undesirably lifting up from the lower dead point.

Unlike in the conventionally-known art sewing machines, the urging member in the present invention need not have a biasing force great enough to prevent the fabric holder from lifting up from the lower dead point; the urging member in the present invention only has to be great enough to retain the fabric holder in a predetermined position relative to the needle bar while the fabric holder is moving together with the vertically moving needle bar. As a result, the present invention can significantly reduce the load torque applied by the urging member to the needle bar and main machine shat.

Further, with the position restricting member mechanically restricting the position of the fabric holder to prevent upward movement, from the lower dead point, of the fabric holder, the force with which the fabric holder is held down by the position restricting member can be made constant so that a sewing workpiece can be held down by the fabric holder with a constant force in a stable manner.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

First Embodiment

Figure 1:
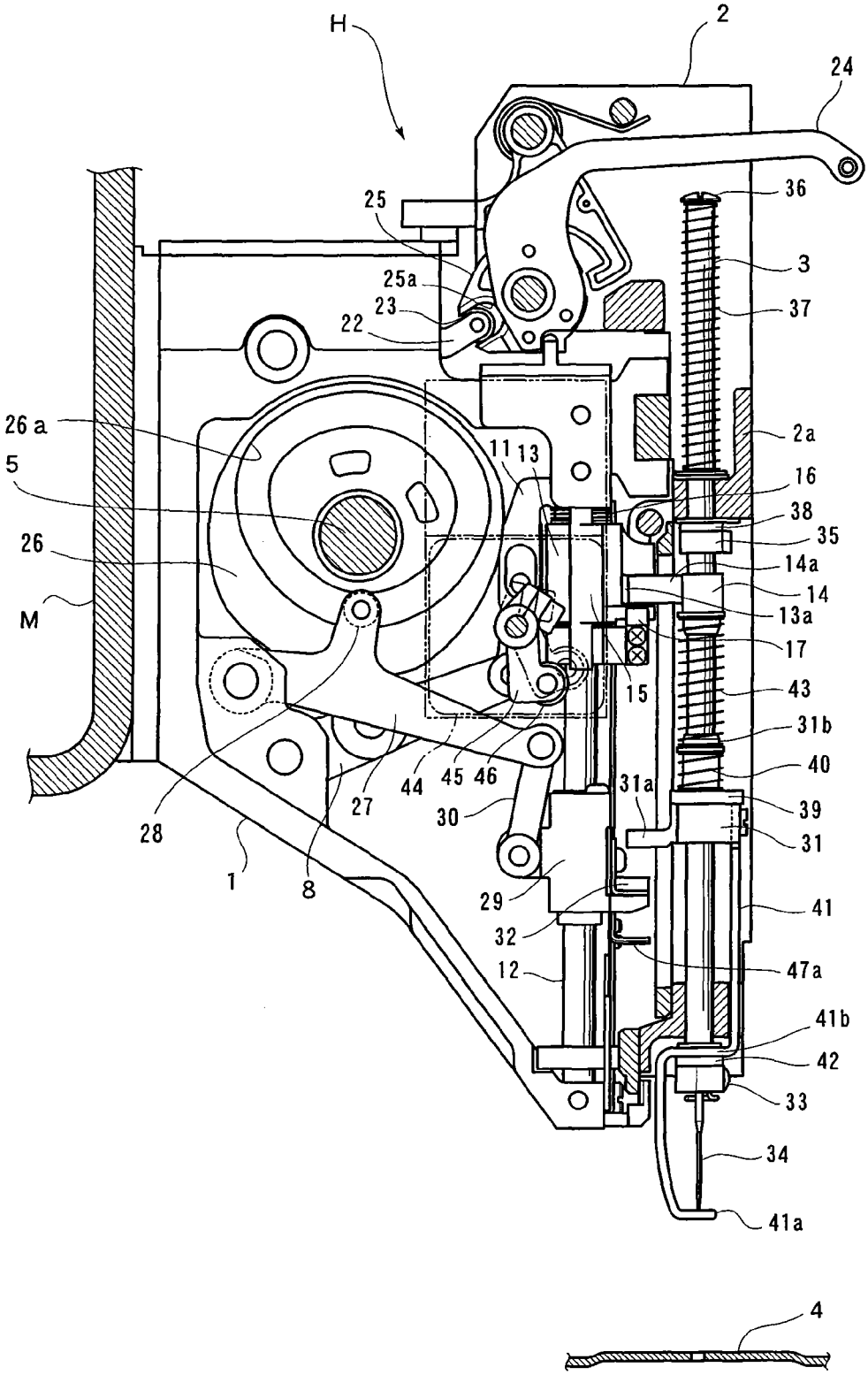
FIG. 1 is a left side view of one of a plurality of machine heads in a multi-head, multi-needle sewing machine according to an embodiment of the present invention, which has a main machine shaft oriented to extend in a left-right horizontal direction of the sewing machine.
Figure 2:
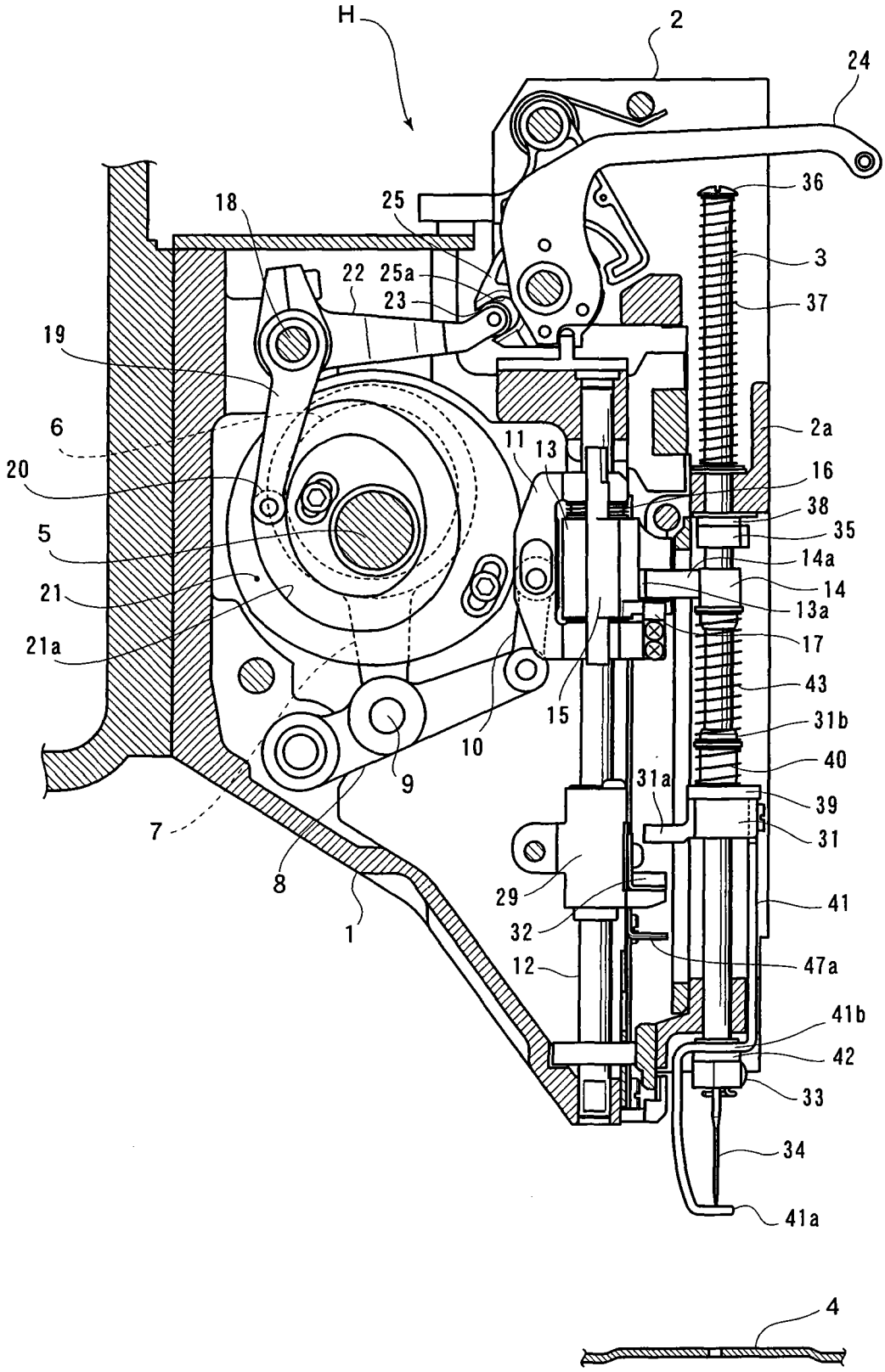
FIG. 2 is a sectional left side view of the machine head shown in FIG. 1.
Figure 3:
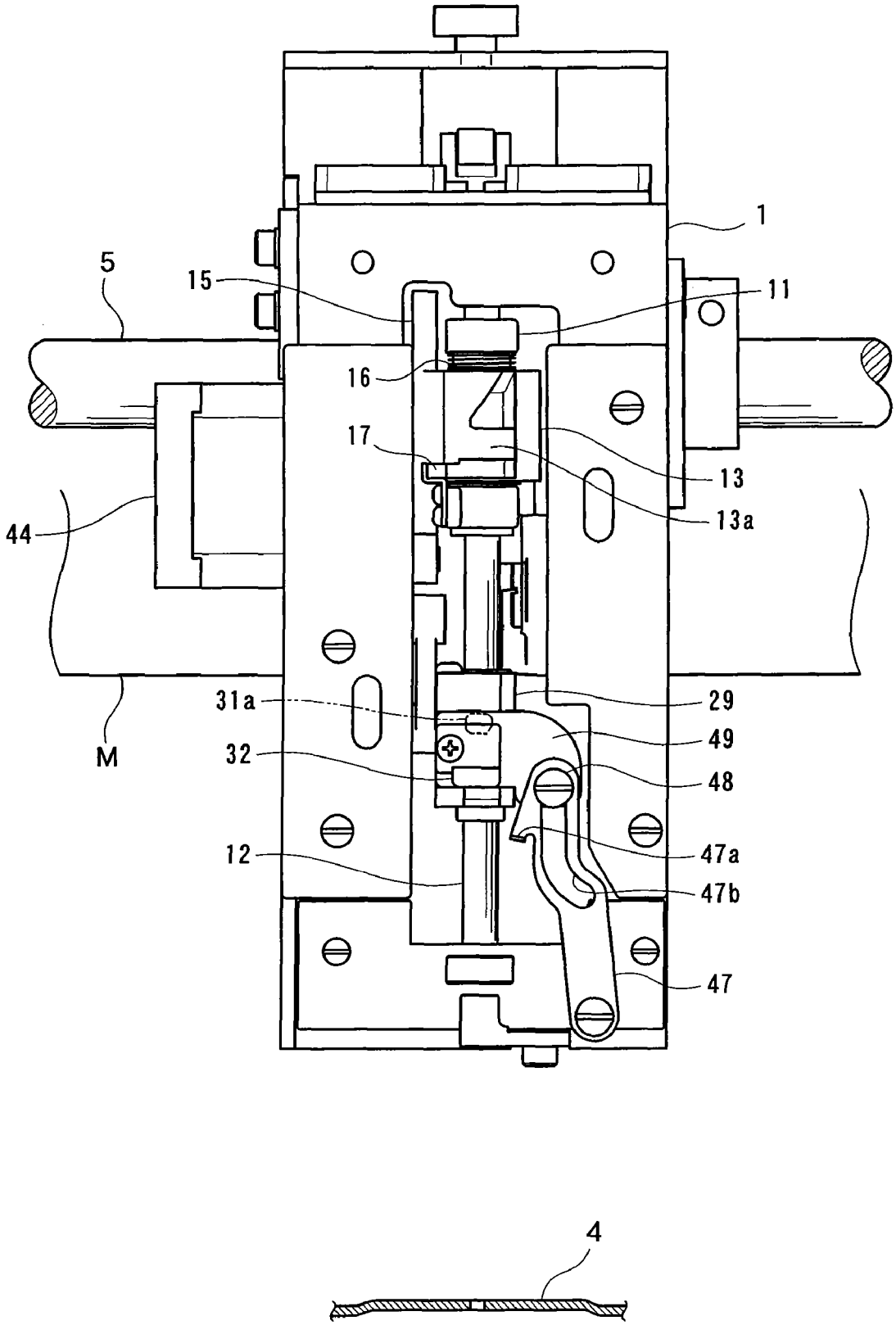
FIG. 3 is a front view of an arm in the machine head shown in FIG. 1.
Figure 4:
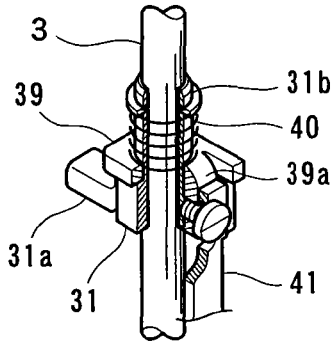
FIG. 4 is an enlarged, partly-broken-away perspective view of a fabric holder clamp in the machine head.

First, with reference to FIGS. 1-8, a description will be given about a sewing machine according to a first embodiment of the present invention, which has a needle-bar driving shaft (i.e., main machine shaft) is oriented to extend in a left-right horizontal direction of the sewing machine. The first embodiment will be described, assuming that the sewing machine is of a multi-head, multi-needle type provided with a plurality of machine heads H. FIG. 1 is a left side view of one of the machine heads H in the multi-head, multi-needle sewing machine having the main machine shaft oriented to extend in the left-right horizontal direction, FIG. 2 is a sectional left side view of the machine head H, FIG. 3 is a front view of an arm 1, and FIG. 4 is an enlarged, partly-broken-away perspective view of a fabric holder clamp in the machine head H. Right side of FIGS. 1 and 2 and one side of FIG. 3 closer to a reader of the figure correspond to a front side of the sewing machine which faces toward a human operator operating the machine for a sewing operation etc.

As shown, each of the machine head H includes the arm 1 fixed to a machine frame M, and a needle bar case 2 supported on the arm 1 in such a manner that it is horizontally sidable relative to the arm 1. A plurality of needle bars 3, only one of which is shown in the figure, are vertically movably provided in the needle bar case 2. The plurality of machine heads H are arranged on the machine frame M at predetermined intervals, and a needle plate 4 is disposed immediately beneath each of the machine heads H. Rotary hook of a conventionally-known construction is provided beneath each of the needle plates 4. As seen in FIG. 3, a main machine shaft 5 extends in the left-right horizontal direction through the arms 1 of the individual machine heads H, and the main machine shaft 5 is driven to rotate via a machine drive motor (not shown). Within the arm 1 of each of the machine heads H, a needle-bar driving cam 6, thread-takeup-lever driving cam 21 and supporting-member driving cam 26 (see FIG. 2).

As clearly seen from FIG. 2, a rod 7 has, at its one end, a ring-shaped portion coupled with an outer periphery of the needle-bar driving cam 6. The rod 7 is connected at the other end to a substantial middle portion of a needle-bar driving lever 8 via a pin 9, and the needle-bar driving lever 8 is pivotally supported by the arm 1. The needle-bar driving lever 8 has a distal end connected with a needle bar elevator member 11 via a connecting member 10, and the needle bar elevator member 11 is vertically movably mounted on a base needle bar 12 that is in turn mounted on the arm 1 and extends vertically parallel to the needle bar 3. Needle-bar driving member 13 rotatable about the axis of the base needle bar 12 is provided on the needle bar elevator member 11 in such a manner that it moves vertically together with the needle bar elevator member 11. The needle-bar driving member 13 has an engaging recessed portion 13*a* shaped so as to be engageable with a projecting engaging pin 14*a* of a needle bar clamp 14 fixed to the needle bar 3. The needle-bar driving member 13 also has an engagement portion 15 of a predetermined vertical length. Torsion spring 16 is provided between the needle bar elevator member 11 and the needle-bar driving member 13, and, by the biasing force of the torsion spring 16, the needle-bar driving member 13 is normally held in a rotational position where it abuts against a stopper 17 fixed to the needle bar elevator member 11. When the needle-bar driving member 13 is in the above-mentioned rotational position, the engaging recessed portion 13*a* engages with the projecting engaging pin 14*a* of a needle bar clamp 14. With such arrangements, as the main machine shaft 5 is driven to rotate, a driving force is transmitted to the needle-bar driving lever 8, via the needle-bar driving cam 6 and rod 7, so that the needle-bar driving lever 8 is caused to pivot vertically. As the needle-bar driving lever 8 vertically in this manner, the needle bar elevator member 11 and needle-bar driving member 13 connected to a distal end portion of the needle-bar driving lever 8 moves vertically, so that the needle bar 3 is driven vertically via the engaging pin 14*a* of the needle bar clamp 14 engaging the engaging recessed portion 13*a*.

As shown in FIG. 2, a support shaft 18 is fixed to a portion of the arm 1 located above the position where the needle-bar driving lever 8 is pivotally supported by the arm 1, and a thread-takeup lever drive member 19 is pivotably mounted on the support shaft 18. Cam follower 20 is provided on a distal end portion of the thread-takeup lever drive member 19, and this cam follower 20 is fitted in a cam groove 21*a* formed in the thread-takeup-lever driving cam 21. Further, a thread takeup driving lever 22 pivotable together with the thread-takeup lever drive member 19 is supported on the support shaft 18, and a roller 23 is provided at the distal end of the thread takeup driving lever 22. In the needle bar case 2, thread takeup levers 24 are vertically pivotably provided in corresponding relation to the needle bars 3. Each of the thread takeup levers 24 has, on its base side, a boss portion 25 having a fitting groove 25*a*. The roller 23 provided at the distal end of the thread takeup driving lever 22 is fitted in the fitting groove 25*a* of the boss portion 25. With such arrangements, as the main machine shaft 5 is driven to rotate, the thread-takeup-lever driving cam 21 rotates so that the driving force is transmitted from the main machine shaft 5 via the thread takeup driving lever 22, and thus, the thread takeup levers 24, having the fitting groove 25*a* in which the roller 23 of the thread takeup driving lever 22 is fitted, is caused to pivot vertically.

As shown in FIG. 1, the supporting-member driving cam 26, fixedly mounted on the main machine shaft 5, has a cam groove 26*a* in which is fitted a cam follower 28 provided on a drive lever 27. Similarly to the needle-bar driving lever 8, the drive lever 27 is pivotally supported by the arm 1. The drive lever 27 is connected at its distal end to a supporting member 29 via a connecting member 30, and the supporting member 29 is vertically-movably mounted on the base needle bar 12. The supporting member 29 has a supporting piece 32 fixed thereto for supporting from below an engaging pin 31*a* of a fabric holder clamp 31 vertically-movably provided on the needle bar 3. With such arrangements, as the main machine shaft 5 is driven to rotate, the supporting-member driving cam 26 rotates so that the drive lever 27 is caused to pivot, and thus, the supporting member 29 (and supporting piece 32) is driven up and down along the base needle bar 12.

Sewing needle 34 is fixed to the lower end of each of the needle bars 3 by means of a fixed needle clamp 33. Each of the needle bars 3 has the needle bar clamp 14 fixed to a substantial middle portion thereof, and the needle bar clamp 14 has the engaging pin 14*a* projecting toward the base needle bar 12. Separate stopper 35 is fixed to a portion of the needle bar 3 above the needle bar clamp 14. Needle-bar holding spring 37 is provided, between a spring stopper 36 at the upper end of each of the needle bars 3 and the upper surface of a horizontal frame 2*a* of the needle bar case 2, in such a manner that it normally urges the needle bar 3 upward. By the biasing force of the needle-bar holding spring 37, the needle bar 3 is normally held at its upper dead point via a cushion 38 of an impact-absorbing soft material abutted against the lower surface of the horizontal frame 2*a*. Further, each of the needle bars 3 has the fabric holder clamp 31 provided, on a substantial middle portion between the fixed needle clamp 33 and the needle bar clamp 14, in such a manner that the fabric holder clamp 31 is vertically movable relative to the needle bar 3. The fabric holder clamp 31 has the engaging pin 31*a* projecting toward the base needle bar 12, and a cylindrical portion 31*b* provided on its upper surface. As clearly seen from FIG. 4, a stopper member 39 is provided on the cylindrical portion 31*b* of the fabric holder clamp 31 in such a manner that it is vertically movable relative to the needle bar 3, and a coil spring 40 for normally urging the stopper member 39 downward is provided on the cylindrical portion 31*b* of the fabric holder clamp 31. The stopper member 39 is formed into a shape integrally having a downwardly-extending portion 39*a* received in a recessed portion formed in a front side of the fabric holder clamp 31. The fabric holder 41 is fixed, by means of a screw or the like, to the downwardly-extending portion 39*a* of the stopper member 39 and extends downward.

The fabric holder 41 has, at its lower end, a fabric holding portion 41*a* through which the sewing needle 34 can pass. The fabric holder 41 also has an abutting portion 41*b* on its substantial middle portion, and the needle bar 3 extends through the abutting portion 41*b*. Cushion 42 of an impact-absorbing soft material is provided between the abutting portion 41*b* and the needle clamp 33. Coil spring (urging member) 43 for normally urging the fabric holder 41 downward is provided between the needle bar clamp 14 and the fabric holder clamp 31. Position of the fabric holder 41 relative to the needle bar 3 is restricted by the abutting portion 41*b* of the fabric holder 41 abutted, by means of the biasing force of the coil spring 43, against the needle clamp 33 via the cushion 42.

Now, a description will be given about a "jump" mechanism for temporarily "jumping" (i.e., temporarily stopping the up-and-down movement of) the needle bar 3 during a sewing operation. As indicated by imaginary lines in FIG. 1, a motor 44 is fixed to one side surface of the arm 1 via a base member. Jump lever 45 is fixed to the shaft of the motor 44, and a roller 46 is rotatably provided on a distal end portion of the jump lever 45. The roller 46 is positioned behind an engagement portion 15 of the needle-bar driving member 13 in such a manner that the roller 46 can contact the engagement portion 15. The jump lever 45 is normally urged by a not-shown torsion spring in a direction where the roller 46 moves away from the engagement portion 15; thus, the jump lever 45 is normally held in a rotational position indicated by a solid line in FIG. 1. As the jump lever 45 is rotated to a position indicated by an imaginary line in FIG. 1 by the motor 44 being activated in response to a predetermined jump signal, the roller 46 presses the engagement portion 15, so that the needle-bar driving member 13 is caused to pivot about the axis of the base needle bar 12 to a jump position in which the engaging recessed portion 13*a* of the needle-bar driving member 13 is disengaged from the engaging pin 14*a* of the needle bar clamp 14 (in the illustrated example, in a direction from a front side of the sheet of the figure (closer to the reader of the figure) toward a reverse side of the sheet of the figure away from the reader of the figure). Thus, the up-and-down movement of the needle-bar driving member 13 is no longer transmitted to the needle bar 3, so that the needle bar 3 and fabric holder 41 are placed in a "jump state" (or temporarily deactivated state). Note that the engagement portion 15 is formed into a predetermined vertical length such that the roller 46 can contact the engagement portion 15 within the vertical or up-and-down movement range of the needle-bar driving member 13.

When the needle-bar driving member 13 is to be returned from the above-mentioned "jump position" to the original rotational position where the engaging recessed portion 13*a* of the needle-bar driving member 13 engages with the engaging pin 14*a* of the needle bar clamp 14, the motor 44 is deactivated so that the jump lever 45 is caused to return, by the biasing force of the torsion spring, to the rotational position indicated by the solid line of FIG. 1. In this way, the needle-bar driving member 13 is caused to return, by the biasing force of the torsion spring 16, to the original rotational position where it abuts against the stopper 17 (in the illustrated example, in a direction from the reverse side of the sheet of the figure toward the front side of the sheet of the figure closer to the reader of the figure), so that the engaging recessed portion 13*a* of the needle-bar driving member 13 is brought into engagement with the engaging pin 14*a* of the needle bar clamp 14.

Next, a description will be given about a position restricting member for preventing unwanted lift-up of the fabric holder 41 located at its lower dead point. As seen in FIG. 3, a holding lever 47 is pivotably supported on a lower-end front surface portion of the arm 1 (i.e., front side of the sewing machine). The holding lever 47, which is in the form of a plate member having, for example, a curved shape as shown in FIG. 3, has a holding portion 47*a* bent to project in a forward direction of the machine (perpendicularly to the sheet of FIG. 3). The holding lever 47 also has a guide groove 47*b* formed therein to extend from its upper portion down to its substantial middle portion along the curved contour of the lever 47. Pin 48 is fitted in the guide groove 47*b* for sliding movement along the guide groove 47*b*, and the pin 48 has one end fixed to a bracket 49 that is in turn fixed to the front surface of the supporting member 29. Thus, as the supporting member 29 vertically moves, the pin 48 moves vertically together with the supporting member 29 while sliding along the guide groove 47*b*, so that the holding lever 47 is caused to pivot vertically. When the fabric holder 41 has reached the lower dead point, the holding lever 47 pivots to hold down and sandwich, from above, the engaging pin 31*a* of the fabric holder clamp 31 between the holding lever 47 and the supporting piece 32 of the supporting member 29 (details of which will be explained later).

Figure 5:
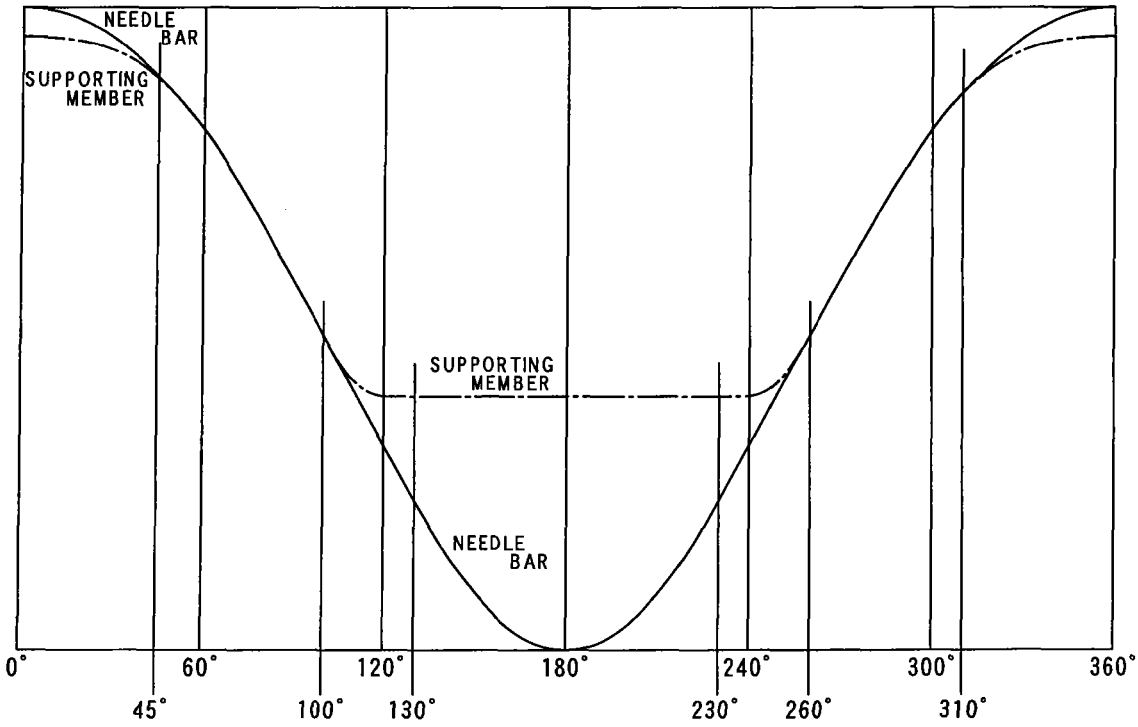
FIG. 5 is a diagram showing motion curves of vertical movement of a needle bar and supporting member in the machine head.
Figure 6:
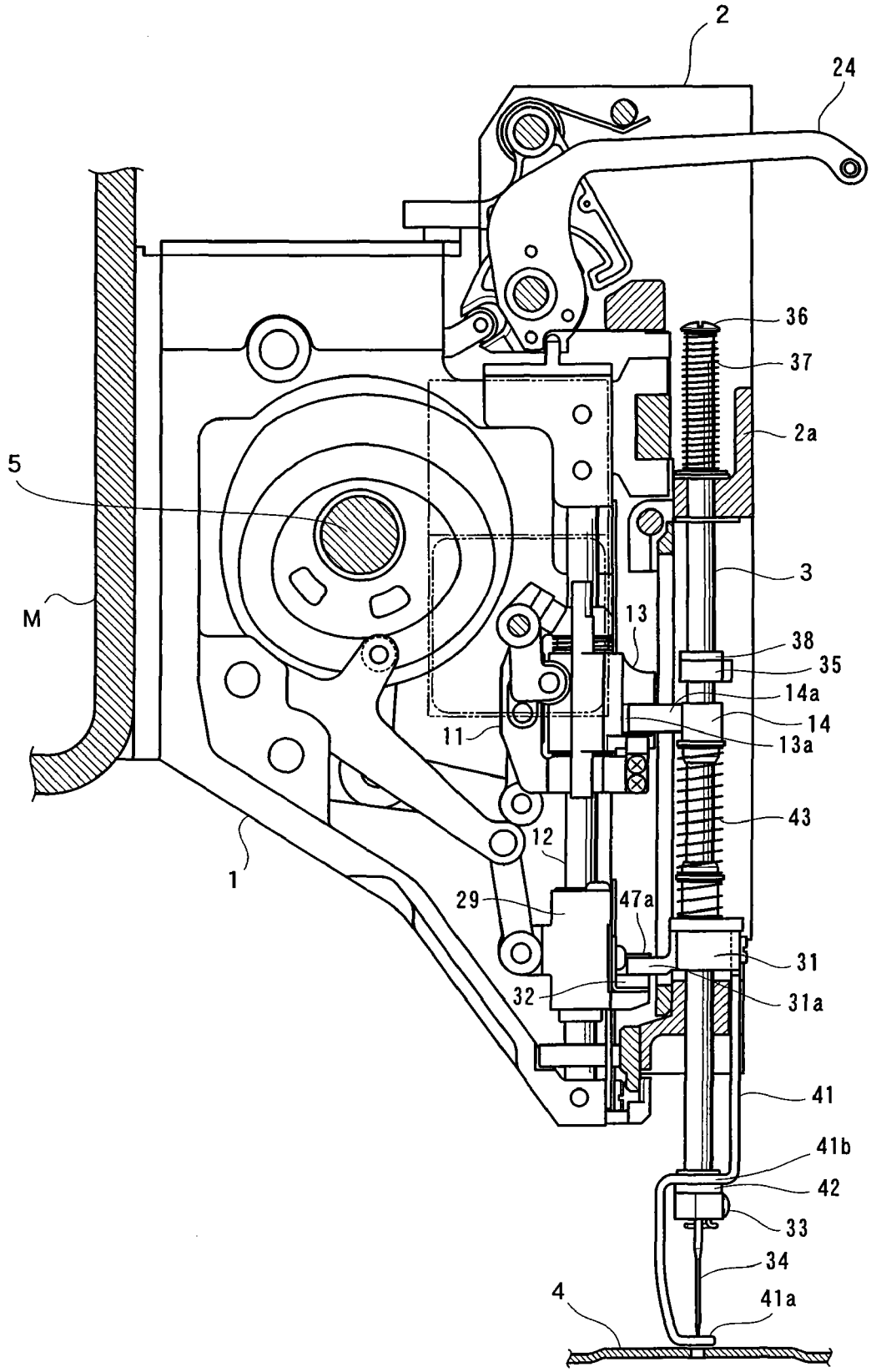
FIG. 6 is a sectional left side view of the machine head when a fabric holder is located at its lower dead point.
Figure 7:
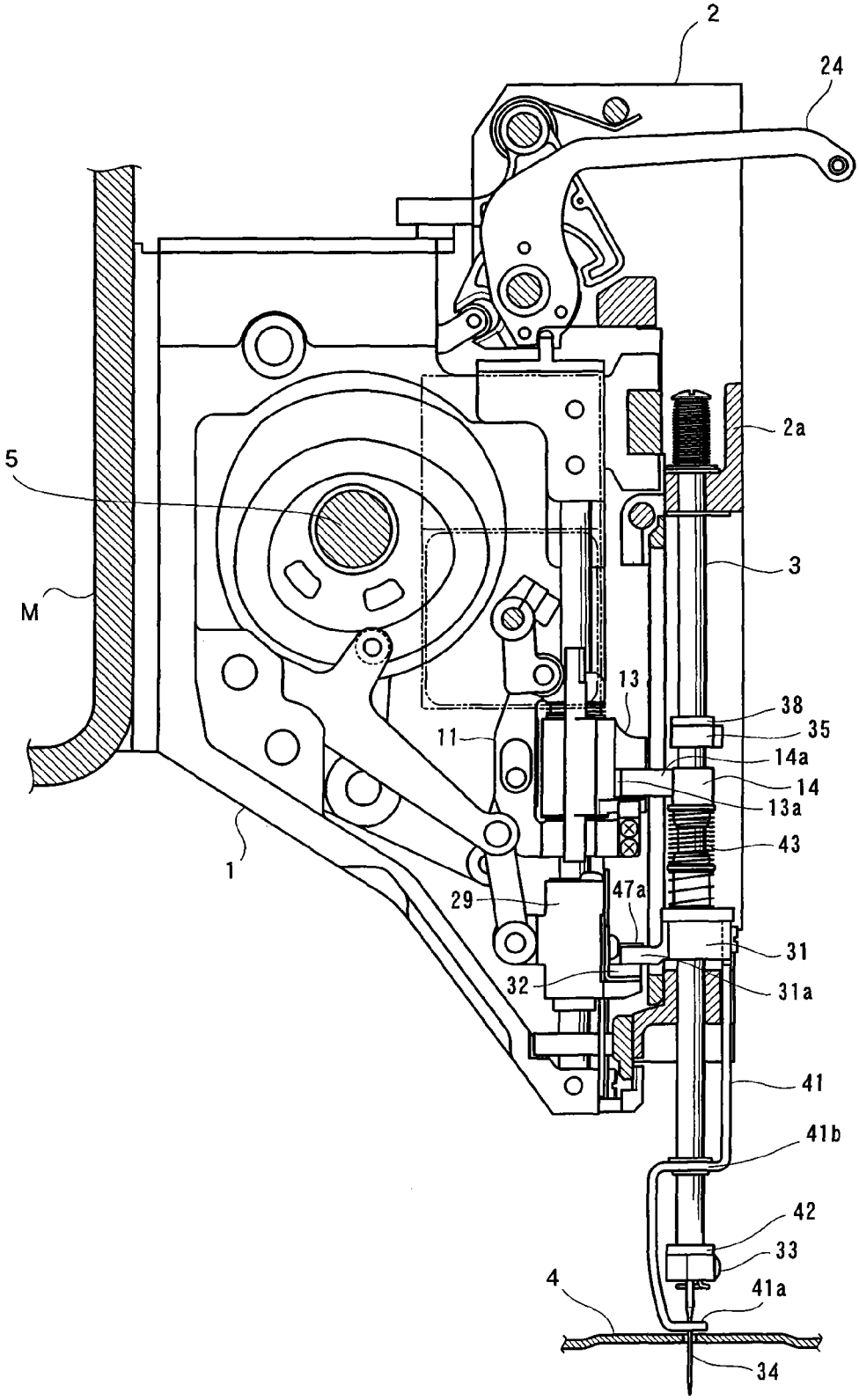
FIG. 7 is a sectional left side view of the machine head when the needle bar and fabric holder are located at their lower dead points.
Figure 8:
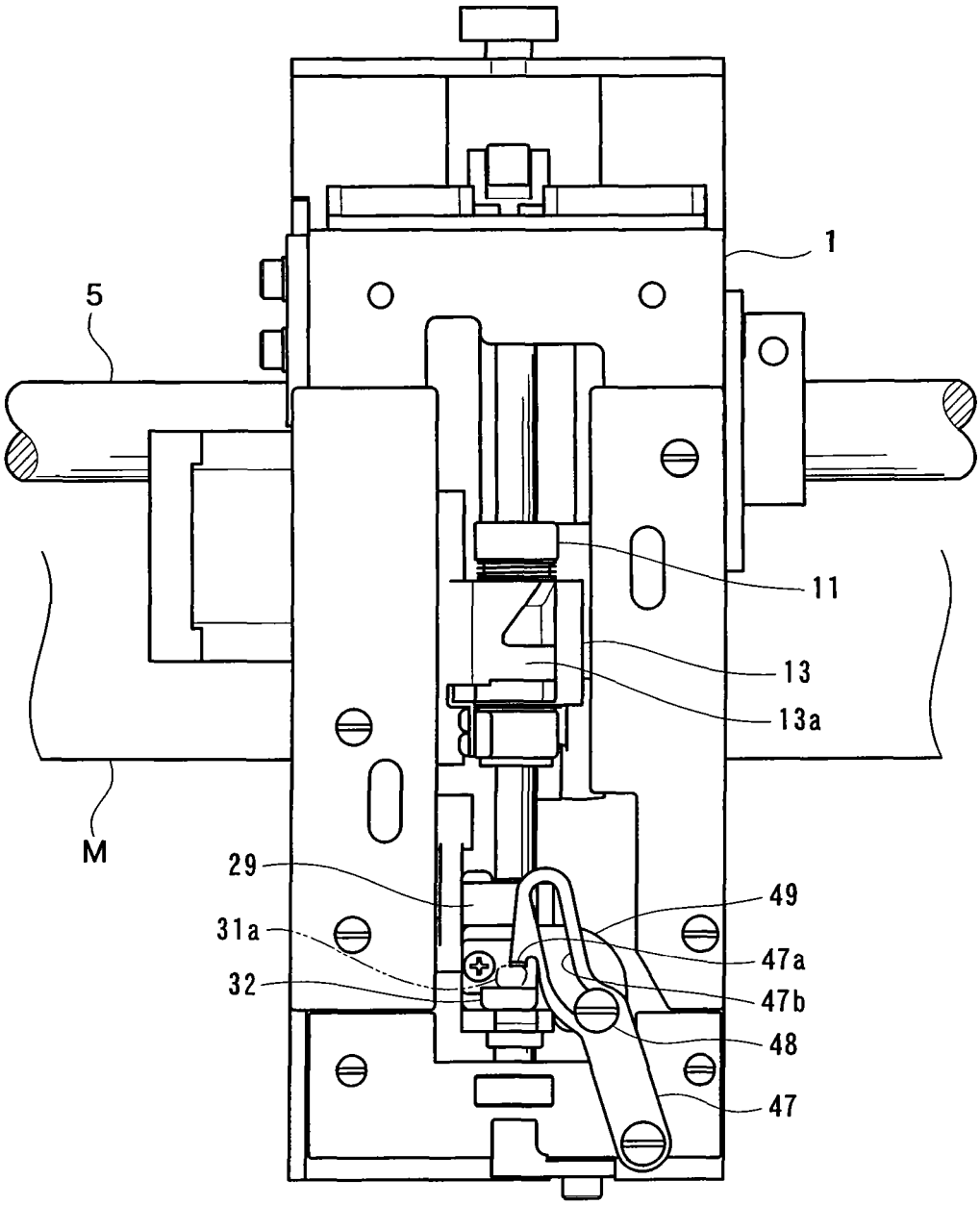
FIG. 8 is a front view of the arm in the machine head shown in FIG. 6.
Figure 8:
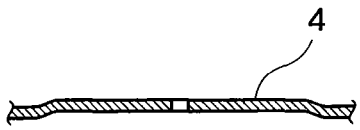

The following paragraphs describe behavior of the instant embodiment constructed in the above-described manner. First, operation of the needle bar 3 and fabric holder 41 will be described. FIG. 5 shows motion curves of the vertical movement of the needle bar 3 and supporting member 29. FIGS. 6 and 7 are left side views of the machine head H, and FIG. 8 is a front view of the arm 1, Note that, in these figures, the fabric holder 41 is shown as located at its lower dead end.

When one needle bar 3 having set thereon a thread of a desired color has been selected, from among the plurality of needle bars 3, by the needle bar case 2 being caused to slide via a not-shown color change mechanism, the selected needle bar 3 is positioned in front of the base needle bar 12 of the arm 1, so that not only the engaging pin 14*a* of the needle bar clamp 14 of the selected needle bar 3 engages the engaging recessed portion 13*a* of the needle-bar driving member 13 but also the roller 23 of the thread takeup driving lever 22 fits into the fitting groove 25*a* of the thread takeup lever 24 corresponding to the selected needle bar 3. Then, as the main machine shaft 5 is driven to rotate, the selected needle bar 3 is driven vertically between the upper dead point shown in FIG. 1 or 2 and the lower dead point shown in FIG. 6 or 7, and the thread takeup lever 24 too vertically pivots in accordance with the vertical movement of the needle bar 3. Further, in response to the rotation of the main machine shaft 5, the supporting member 29 too is driven vertically between the upper dead point shown in FIG. 1 or 2 and the lower limit position shown in FIG. 6 or 7. Such movement of the needle bar 3 and supporting member 29 is plotted in FIG. 5. In FIG. 5, the horizontal axis indicates the rotational angle of the main machine shaft 5 with the rotational angle when the needle bar 3 is at the upper dead point being set as 0°, while the vertical axis represents the stroke value with the lower dead point of the needle bar 3 or supporting member 29 being set as a reference stroke value. As the needle bar 3 starts descending from the upper dead point, the fabric holder 41 starts descending, concurrently with the needle bar 3, by being urged by the coil spring 43. At that time, the supporting member 29 starts descending from the upper limit position concurrently with the start of the descending of the needle bar 3, as shown in FIG. 5. The supporting member 29 reached the substantially the same descending speed as the needle bar 3 when the rotational angle of the main machine shaft 5 (main shaft angle) is 45°. Further, at that time point, the lower surface of the engaging pin 31*a* of the fabric holder clamp 31 and the upper surface of the supporting piece 32 of the supporting member 29 are located at the same height so that the engaging pin 31*a* is received softly by the supporting piece 32, which can thereby avoid generation of a collision sound.

Then, as the supporting member 29 continues descending at the same speed as the needle bar 3 until the main shaft angle reaches about 100°, so that the fabric holder 41 continues descending with the engaging pin 31*a* kept contacting the supporting piece 32. Then, the descending speed of the supporting member 29 is gradually reduced before the main shaft angle reaches 120° after exceeding 100°. Once the main shaft angle reaches 120°, the supporting member 29 completely stops descending, so that the fabric holder 41 is retained at the lower dead point as shown in FIG. 6. In the state shown in FIG. 6, the holding portion 47*a* of the holding lever 47 pivoting as the supporting member 29 descends is in abutting engagement with the upper surface of the engaging pin 31 of the fabric holder clamp 31 contacting the supporting piece 32, as will be later detailed. Even after that, the needle bar 3 further continues descending, and the sewing needle 34 is inserted through a sewing workpiece (not shown) when the main shaft angle is about 130°. Then, after the needle bar 3 reaches the lower dead point of FIG. 7 when the main shaft angle is 180°, it shifts to ascending movement from the lower dead point. Then, the sewing needle 34 is driven out of the sewing workpiece when the main shaft angle is about 230° and further continues to ascend toward the upper dead point.

Meanwhile, the supporting member 29 is retained in the lower limit position while the main shaft angle is in the range of 120° to 240°, during which time the holding portion 47*a* of the holding lever 47 holds down, from above, the engaging pin 31 of the fabric holder clamp 31 on the supporting piece 32; thus, the fabric holding portion 41*a* of the fabric holder 41 can reliably hold down the sewing workpiece throughout a period of time from immediately before the sewing needle 34 is inserted through the sewing workpiece to immediately after the sewing needle 34 is driven out of the sewing workpiece. Thus, even though the biasing force of the coil spring 43 varies, due to variation in its compressed state, in response to the vertical movement of the sewing needle 3, as illustratively shown in FIGS. 6 and 7, the fabric holder 41 can stably hold down the sewing workpiece, because the engaging pin 31*a* of the fabric holder clamp 31 is vertically sandwiched and retained between the holding portion 47*a* and the supporting piece 32 and thus the force with which the fabric holder 41 holds down the sewing workpiece can remain constant without varying in response to the vertical movement of the sewing needle 3. Once the supporting member 29 starts gradually ascending at the time point when the main shaft angle is 240°, the holding lever 47 is caused to pivot so that the holding portion 47*a* no longer holds down the engaging pin 31*a* (as will be later described). Thus, the engaging pin 31*a* is lifted up by the supporting piece 32, because of which the fabric holder 41 starts gradually ascending. At a time point when the main shaft angle is 260°, the fabric holder 41 ascending together with the supporting member 29 reaches the same speed as the ascending needle bar 3 and the lower surface of the abutting portion 41*b* of the fabric holder 41 and the upper surface of the cushion 42 are brought to the same height, so that the cushion of an impact-absorbing soft material softly hits the abutting portion 41*b*. As a consequence, generation of a collision sound can be avoided. After that, the supporting member 29 ascends at the same speed as the needle bar 3, then starts gradually slowing down at a time point when the main shaft angle is 310°, and then returns to the upper limit position shown in FIG. 1 or 2 at a time point when the main shaft angle is 360°.

Next, a description will be given about the position restricting member for reliably preventing unwanted lift-up of the fabric holder 41 located at its lower dead point. Once the supporting member 29 starts descending in response to the pivoting movement of the main machine shaft 5, the pin 48, fixed to the bracket 49 bracket 49 on the front surface of the supporting member 29, too starts descending. As seen from FIG. 3, an upper portion of the guide groove 47*b* of the holding lever 47 has a shape extending straight downward, so that the holding lever 47 is held in an "evacuating position" as shown in FIG. 3, without being moved, for a while after the start of the descending movement of the pin 48. Once the pin 48 reaches a curved portion of the guide groove 47*b*, the holding lever 47 starts pivoting in a counterclockwise direction of FIG. 3. By that time, the engaging pin 31*a* of the fabric holder clamp 31 has already been located below the holding portion 47*a* of the holding lever 47 so that the holding portion 47*a* is prevented from interfering with the descending engaging pin 31*a*; namely, the shape of the guide groove 47*b* etc. are set in advance so as to allow the engaging pin 31*a* of the fabric holder clamp 31 to be located below the holding portion 47*a* prevent the holding lever 47 by that time. When the supporting member 29 has reached the lower limit position by further continuing descending together with the pin 48, the holding lever 47 has already pivoted to an "operating position", as seen from FIG. 8, in which the holding portion 47*a* abuts against the upper surface of the engaging pin 31*a* of the fabric holder clamp 31 contacting the supporting piece 32. Thus, while the holding lever 47 is in the above-mentioned "evacuating position", the fabric holder 41 is permitted to move vertically, but, while the holding lever 47 is in the above-mentioned "operating position", the fabric holder 41 can be prevented from lifting up from the lower dead point by the holding portion 47*a* of the holding lever 47 abutting against the upper surface of the engaging pin 31*a* of the fabric holder clamp 31 held on the supporting piece 32.

Then, as the supporting member 29 starts ascending from the lower limit position together with the pin 48 after completion of the descending movement, the holding lever 47 is caused to pivot toward the evacuating position, so that the holding portion 47*a* moves away from the engaging pin 31*a* of the fabric holder clamp 31 and out of a vertical movement path of the pin 31*a*. In this way, the fabric holder 41 ascends together with the needle bar 3 without the engaging pin 31*a* of the fabric holder clamp 31 interfering with the holding portion 47*a* of the holding lever 47. The fabric holder 41 may sometimes hold down a folded-back portion or other thicker portion of a fabric by means of its fabric holding portion 41*a*, in which case the lower dead point would rise due to the greater thickness of the fabric. In such a case, the rise of the lower dead point of the fabric holder 41 is permitted by the stopper member 39 moving upward against the biasing force of the coil spring 40. Note that the biasing force of the coil spring 40 is great enough to just prevent unwanted lift-up of the sewing workpiece. In the aforementioned manner, the bracket 49, pin 48, guide groove 47*b*, etc. together constitute a link mechanism, which functions to convert the linear reciprocative motion of the supporting member 29 to such motion for moving the holding lever (i.e., position restricting member) 47 between the "operating position" and the "evacuating position".

Second Embodiment

Figure 9:
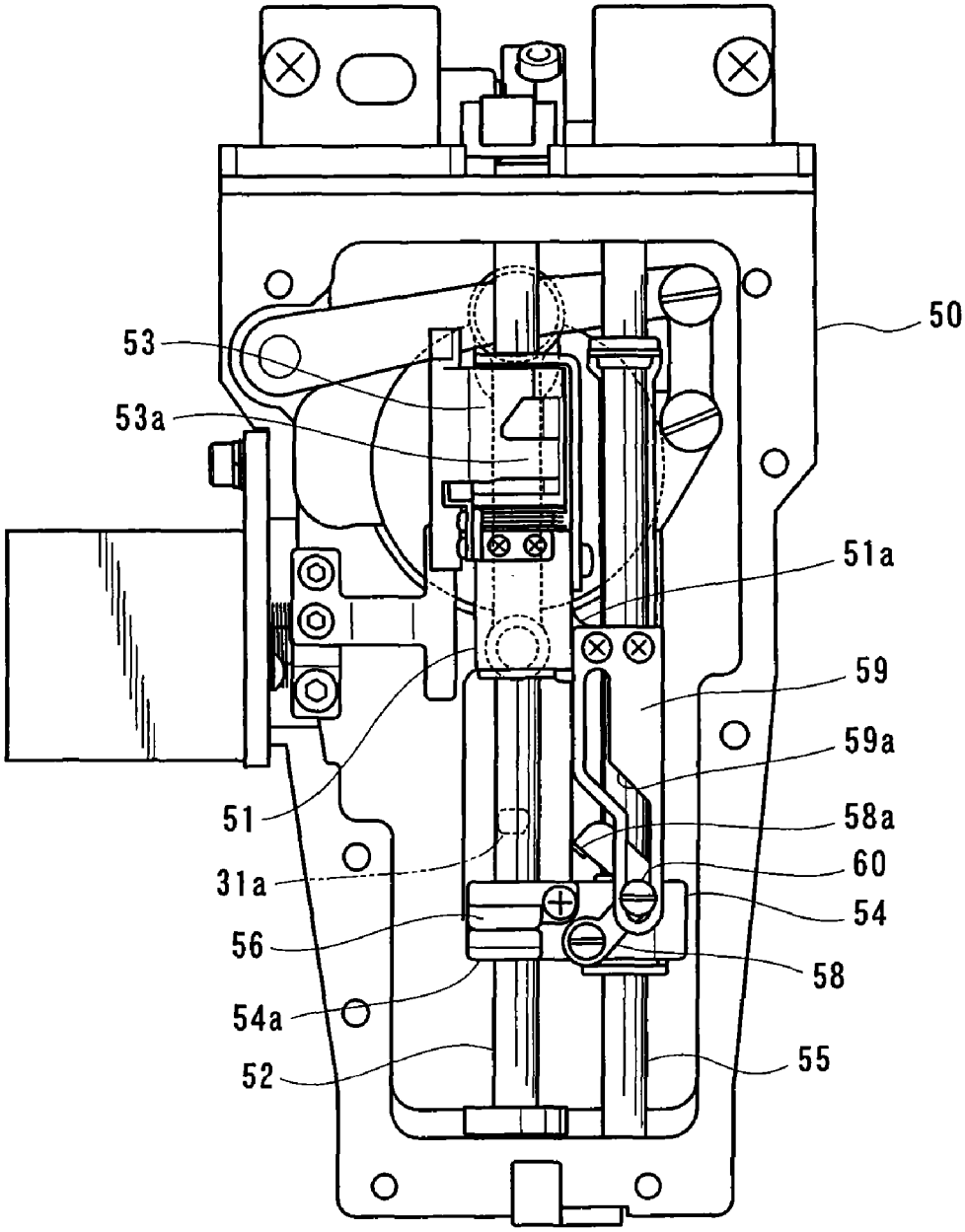
FIG. 9 is a front view of the arm in one of the plurality of machine heads in a sewing machine in accordance with a second embodiment of the present invention where the main machine shaft is oriented to extend in a front-rear horizontal direction of the sewing machine, which particularly shows the needle bar and fabric holder located at their upper dead points.
Figure 9:
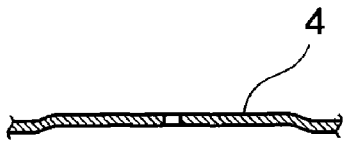
Figure 10:
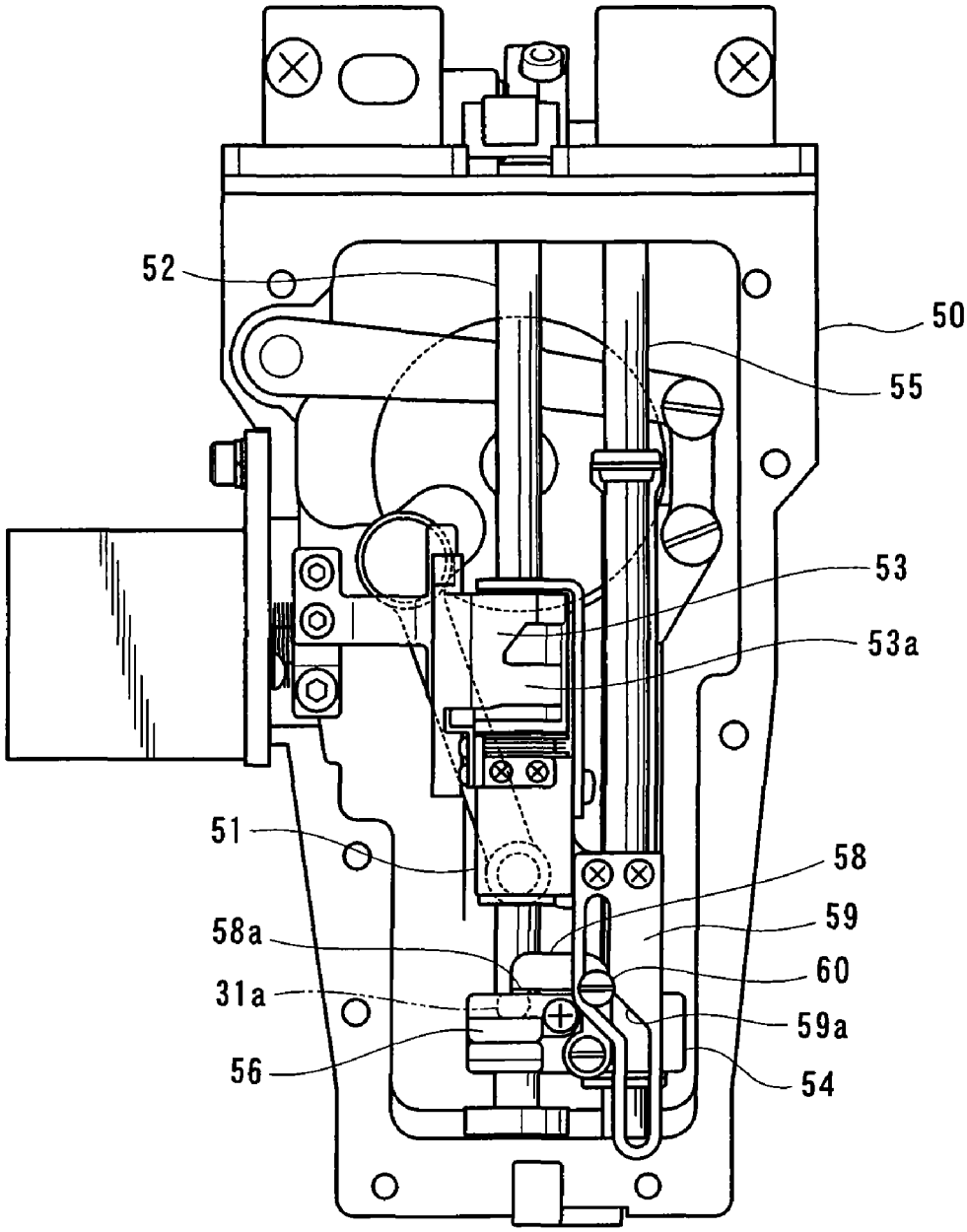
FIG. 10 is a front view of the arm in the sewing machine of FIG. 9, which particularly shows the fabric holder having reached its lower dead point.
Figure 10:
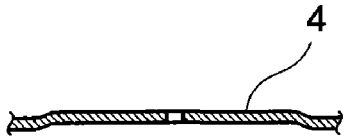
Figure 11:
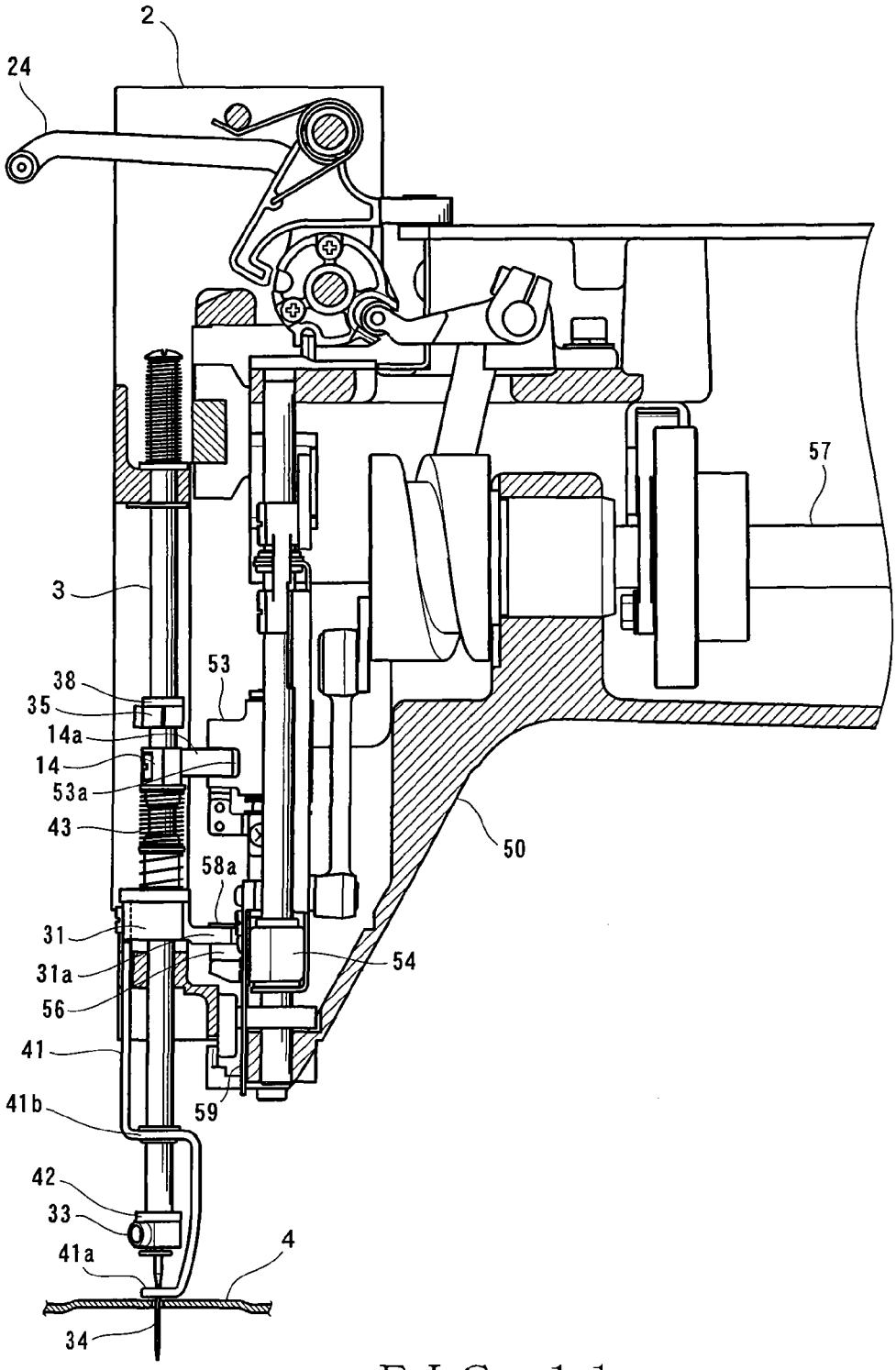
FIG. 11 is a right side view of one of the machine heads in the sewing machine of FIG. 9.

The following paragraphs describe a sewing machine in accordance with a second embodiment of the present invention, which is of a so-called arm type having the needle-bar driving shaft (i.e., main machine shaft) oriented to extend in the front-rear direction of the sewing machine, with reference to FIGS. 9-11. FIGS. 9 and 10 are front views of the arm 50 in one of the plurality of machine heads. Note that FIG. 9 shows a state of the sewing machine when the needle bar 3 and fabric holder 41 are located at their respective upper dead points, and FIG. 10 shows a state of the sewing machine when the fabric holder 41 has reached the lower dead point. Further FIG. 11 is a right side view of the machine head, which particularly shows a state of the sewing machine when the needle bar 3 and fabric holder 41 are located at their respective lower dead points.

In the arm-type sewing machine, the needle bar case 2 is supported on the front surface of the arm 50 in such a manner that it is horizontally sidable relative to the arm 50. The needle bar case 2 may be constructed in the same manner as described above in relation to the first embodiment and thus will not be described in detail here to avoid unnecessary duplication. First base shaft 52 is provided in front of the arm 50 and located, as viewed from the front of the sewing machine, in a substantial middle portion, in the left-right horizontal direction, of the arm 50, and the first base shaft 52 is supported at its upper and lower ends by the arm 50. Second base shaft 55, supported at its upper end lower ends by the arm 50 similarly to the first base shaft 52, is located to one side (in the illustrated example, to the right) of the first base shaft 52 and extends parallel to the first base shaft 52. Needle-bar drive (or elevator) member 51 for vertically driving the needle bar 3 up and down is vertically movably mounted on the first base shaft 52, and a needle-bar driving member 53 is mounted on the first base shaft 52 in such a manner that it is pivotable about the axis of the first base shaft 52 and vertically movable together with the base shaft 52. Further, the needle-bar driving member 53 has an engaging recessed portion 53*a* engageable with the projecting engaging pin 14*a* of the needle bar clamp 14. Supporting member 54 is provided on the second base shaft 55, and a supporting piece 56 for supporting the engaging pin 31*a* of the fabric holder clamp 31 is fixed to the supporting member 54.

The above-mentioned needle-bar drive (elevator) member 51 and supporting member 54 are vertically moved by rotation of the main machine shaft 57 shown in FIG. 11. Further, the needle-bar drive member 51 and supporting member 54 each have a fork portion 51*a* or 54*a*. The fork portion 51*a* of the needle-bar drive member 51 engages with the second base shaft 55 to restrict rotation of the needle-bar drive (elevator) member 51 relative to the needle-bar drive (elevator) member 51, while the fork portion 54*a* of the supporting member 54 engages with the first base shaft 52 to restrict rotation of the supporting member 54 relative to the second base shaft 55. In this way, the needle-bar drive member 51 and supporting member 54 can vertically move in a stable manner at any time.

Drive mechanisms for these elements are well known in the art and thus will not be described in detail here. Operation of the needle-bar drive member 51 and supporting member 54, in other words operation of the needle bar 3 and fabric holder 41, in the second embodiment is similar to that in the first embodiment and thus will not be described here to avoid unnecessary duplication.

Next, a description will be given about the position restricting member employed in the second embodiment for reliably preventing lift-up of the fabric holder 41 located at its lower dead point. Holding lever 58, which is in the form of a plate member, is pivotably supported in a predetermined angular posture on the front surface of the supporting member 54 (front side of the sewing machine), and the holding lever 58 has, at its distal end, a holding portion 58*a* bent to project downward in the vertical direction of the machine. The holding portion 58*a* of the holding lever 58 is formed to hold down and sandwich, from above, the engaging pin 31*a* of the fabric holder clamp 31 between the holding portion 58*a* and the supporting piece 56 of the supporting member 54, when the fabric holder 41 has reached the lower dead point. Guide member 59 in the form of a plate having a guide groove 59*a* shaped into, for example, a crank shape as shown is fixed to the front surface of the fork portion 51*a* of the needle-bar drive member 51, and a pin 60, having one end fixed to a substantial middle portion of the holding lever 58, is fitted in the guide groove 59*a* for sliding movement along the guide groove 59*a*.

The aforementioned holder lever 58 operates as follows. While the needle-bar drive member 51 and supporting member 54 are at their respective upper dead points, the holder lever 58 is held in an "evacuating position" as shown in FIG. 9. As the needle-bar drive member 51 and supporting member 54 are caused to start descending from the upper dead points by the rotation of the main machine shaft 57, not only the holding lever 58 pivotally supported on the supporting member 54 and the pin 60 fixed at one end to the holding lever 58 but also the guide member 59 start descending. Because a lower portion of the guide groove 59*a* is formed straight downward and the pin 60 and guide member 59 both descend simultaneously (but at different speeds; the guide member 59 descends at a slightly higher speed than the pin 60), the holding lever 58 remains held in the "evacuating position" for a while following the start of the descending. Once the pin 60 reaches a slanting portion of the guide groove 59*a* as the descending movement progresses, the holding lever 58 starts pivoting counterclockwise. By that time, the engaging pin 31*a* of the fabric holder clamp 31 has already been located below the holding portion 58*a* of the holding lever 58 (the shape of the guide groove 59*a* etc. are set in advance so as to allow the engaging pin 31*a* of the fabric holder clamp 31 to be located below the holding portion 58*a* by that time), so that the engaging pin 31*a* of the descending fabric holder clamp 31 can be prevented from interfering with the holding portion 58*a* of the holding lever 58 having pivoted counterclockwise as noted above. When the supporting member 54 has reached the lower limit position by further continuing descending, the holding lever 58 has already pivoted to an "operating position", as seen in FIG. 10, in which the holding portion 58*a* of the lever 58 abuts against the upper surface of the engaging pin 31*a* of the fabric holder clamp 31 contacting the supporting piece 56. Then, the needle bar 3 descends to the lower dead point as shown in FIG. 11 by the needle-bar drive member 51 and guide member 59, other than the supporting member 54, further continuing descending. During that time, the pin 60 slides along an upper straight portion of the guide groove 59*a*, so that the holding lever 58 remains held in the "evacuating position". Thus, the fabric holder 41 can be prevented from lifting up from the lower dead point by the holding portion 58*a* holding down the engaging pin 31*a* from above.

Then, as the needle-bar drive member 51 starts ascending from the lower dead point after completion of the aforementioned descending movement and then the supporting member 54 starts ascending, the holding lever 58 is caused to pivot clockwise from the "operating position" toward the "evacuating position", so that the holding portion 58*a* moves away from the engaging pin 31*a* of the fabric holder clamp 31, having so far been held down thereby, and out of the vertical movement path of the pin 31*a*. In this way, the fabric holder 41 ascends together with the needle bar 3 without the engaging pin 31*a* of the fabric holder clamp 31 interfering with the holding portion 58*a*. In the aforementioned manner, the guide member 59, guide groove 59*a*, pin 60 etc. together constitute a link mechanism, which functions to convert the linear reciprocative motion of the supporting member 54 to such motion for moving the holding lever (i.e., position restricting member) 58 between the "operating position" and the "evacuating position".

Third Embodiment

Figure 12:
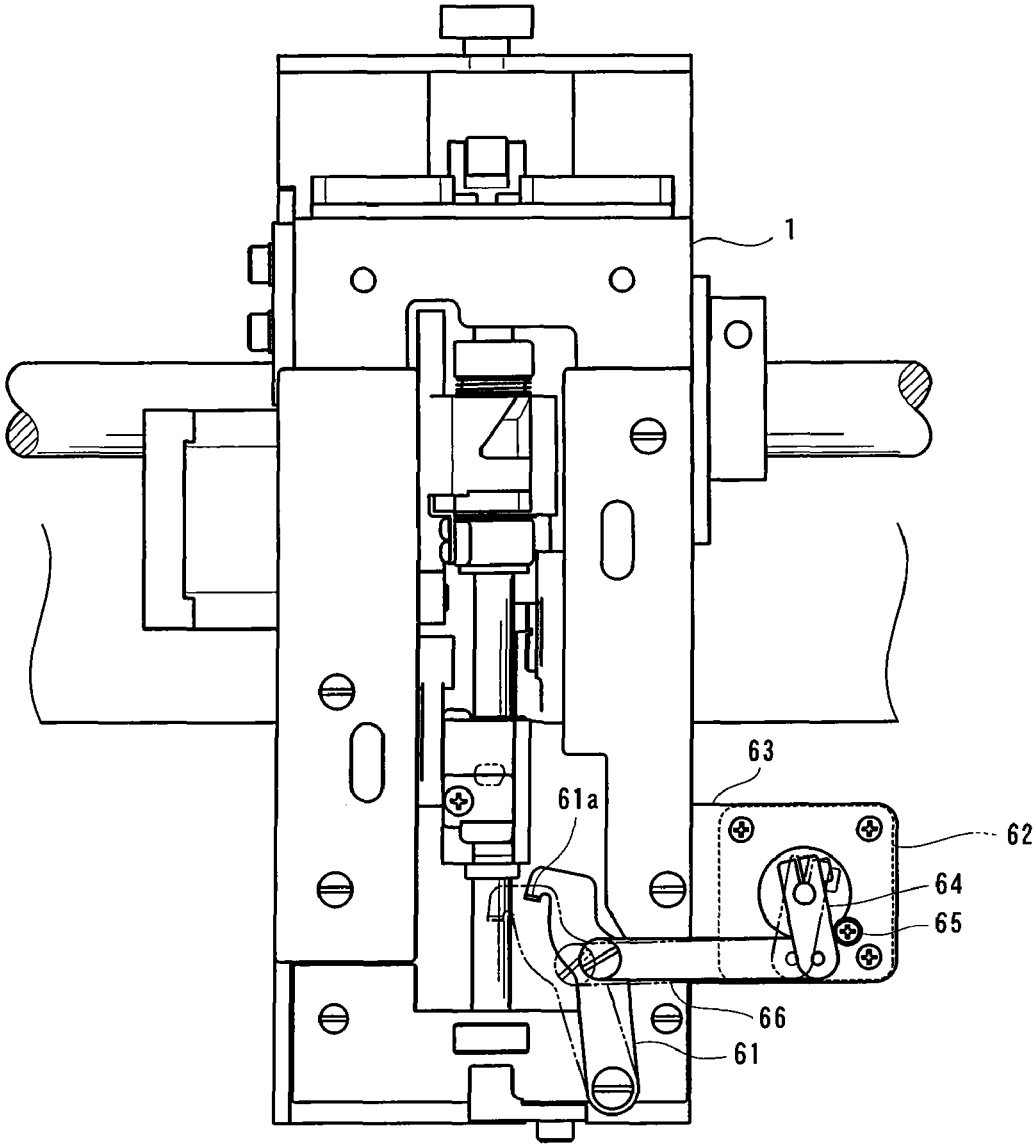
FIG. 12 is a view showing a third embodiment of the present invention, where a position restricting member is driven by a motor.
Figure 13A:
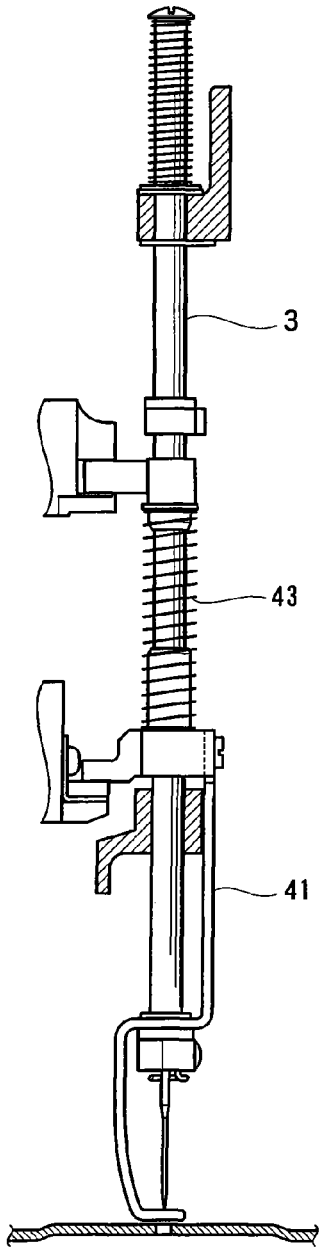
(PRIOR ART) FIG. 13A
FIG. 13A is a view schematically showing a fabric holder having reached its lower dead point in a conventionally-know sewing machine equipped with a supporting member.
Figure 13B:
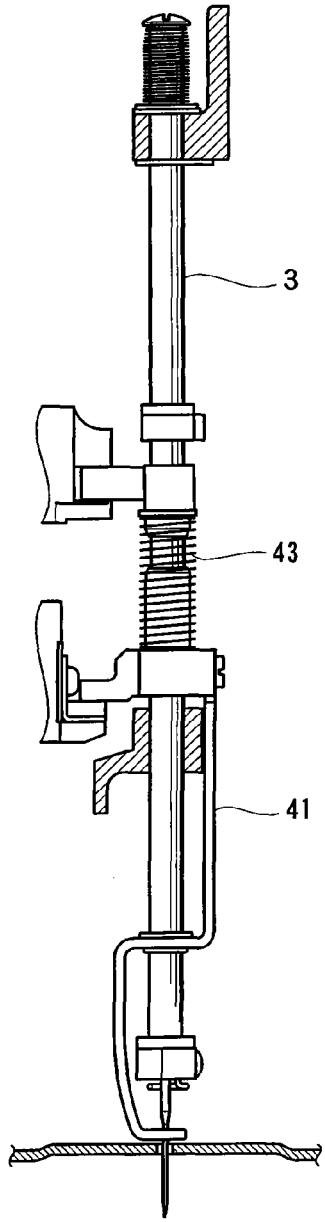
(PRIOR ART) FIG. 13B
FIG. 13B is a view schematically showing a needle bar located at its lower dead point in the conventionally-know sewing machine shown in FIG. 13A.

Whereas each of the first and second embodiments has been described above as constructed so that the holding lever 47 or 58 is caused to pivot by the vertical movement of the supporting member 29 or 54, the present invention is not so limited. For example, there may be provided a dedicated drive source (e.g., motor) for causing the holding lever 47 or 58 in response to the vertical movement of the supporting member 29 or 54. FIG. 12 shows a third embodiment of the present invention, where the position restricting member is driven by a motor mounted on the arm 1 similar to the arm 1 in the first embodiment. In this third embodiment, a holding lever 61 having a holding portion 61*a* is pivotably supported on a lower end portion of the arm 1. Motor 62 is fixed to one side of the arm 1 via a bracket 62. Driving lever 64 is fixed to the shaft of the motor 62. The driving lever 64 has its distal end connected with a substantial middle portion of the holding lever 61 via a connecting lever 66. Torsion spring (not shown) is mounted on the shaft of the motor 62, to normally urge the driving lever 64 into abutting engagement with a stopper 65 fixed to the bracket 63. Thus, the holding lever 61 is normally held in an "evacuating position" as shown in FIG. 12. Once the fabric holder 41 reaches its lower dead point, the motor 62 is activated to cause the holding lever 61 to an "operating position" as indicated by an imaginary line in FIG. 12. By thus causing the holding lever 61 to pivot by means of the motor 62 and controlling the rotation of the motor 62 in association with the rotation of the main machine shaft, vertical stroke of the needle bar, etc. (particularly in association with the vertical stroke of the supporting member 29 or 54) and in a desired pattern, pivot timing of the holding lever 61 can be set as desired. The motor 62 may be a rotary solenoid or other type of rotary actuator, or a linear actuator, such as a push-pull solenoid.

In each of the above-described embodiments, the shape of the holding lever 47, 58 or 61 and the shape of the guide groove 47*b* or 59*a* are not limited to those shown and described above. Further, whereas each of the embodiments has been described above as employing the pivotable holding lever 47, 58 or 61 as the position restricting member for preventing unwanted lift-up of the fabric holder 41 located at the lower dead point, the position restricting member may be of any other suitable construction; for example, it may be in the form of a linearly movable pin.

According to each of the embodiments, as described above, the holding portion 47*a*, 58*a* or 61*a* of the holding lever 47, 58 or 61 is constructed so that, when the fabric holder 41 has reached the lower dead point, the holding portion 47*a*, 58*a* or 61*a* abuts against the upper surface of the engaging pin 31*a* of the fabric holder clamp 31 and sandwiches the engaging pin 31*a* between the holding portion 47*a*, 58*a* or 61*a* and the supporting piece 32 or 56. In this way, the fabric holder 41 can be reliably retained at the lower dead point and prevented from lifting up from the lower dead point. Thus, the biasing force of the coil spring 43 only has to be great enough to allow the fabric holder 41 to move together with the vertically moving needle bar 3. As a result, the present invention can significantly reduce the load torque applied to the main machine shat 5 or 57. Further, because the fabric holder 41 is held down at the lower dead point mechanically by means of the holding portion 47*a*, 58*a* or 61*a*, the force with which the fabric holder 41 is held down can remain constant so that the sewing workpiece can be held down with a constant force in a stable manner. Further, because the fabric holder 41 is vertically moved together with the needle bar 3 by means of the coil spring 43, it is only necessary to jump the needle bar 3 in order to temporarily deactivate the needle bar 3 and fabric holder 41, which can effectively prevent generation of big noise sounds during the jump operation.

What is claimed is:

1. A sewing machine comprising:

a needle bar that is vertically moved to perform a sewing operation;

a drive mechanism for driving said needle bar to move vertically;

a fabric holder supported on said needle bar in such a manner that said fabric holder is vertically movable relative to said needle bar;

a spring for normally urging downward said fabric holder on said needle bar; and a position restricting member for mechanically restricting a position of said fabric holder to prevent upward movement of said fabric holder having reached a lower dead point along with vertical movement of said needle bar.

2. A sewing machine as claimed in claim 1 which further comprises a control mechanism for selectively positioning said position restricting member in either an operating position for preventing the upward movement of said fabric holder or an evacuating position for not preventing the upward movement of said fabric holder, and wherein said control mechanism positions said position restricting member in the operating position when said fabric holder has reached the lower dead point and positions said position restricting member in the evacuating position when said fabric holder has left the lower dead point.

3. A sewing machine as claimed in claim 2 which further comprises a supporting member that is reciprocatively driven between predetermined upper and lower limit positions in synchronism with the vertical movement of said needle bar, and wherein, in the lower limit position, said supporting member defines the lower dead point of said fabric holder by supporting, from below, a predetermined portion of said fabric holder, and said control mechanism causes said position restricting member to move between the operating position and the evacuating position in response to reciprocative movement of said supporting member.

4. A sewing machine as claimed in claim 3 wherein said control mechanism comprises a mechanism for converting linear reciprocative movement of said supporting member to motion that causes said position restricting member to move between the operating position and the evacuating position.

5. A sewing machine as claimed in claim 2 wherein said control mechanism comprises a motor, and a transmission mechanism for, in response to rotation of said motor, causing said position restricting member to move between the operating position and the evacuating position.

6. A sewing machine comprising:

a needle bar that is vertically moved to perform a sewing operation;

a fabric holder supported on said needle bar in such a manner that said fabric holder is vertically movable relative to said needle bar;

a spring for normally urging downward said fabric holder on said needle bar; and a position restricting member for mechanically restricting a position of said fabric holder to prevent upward movement of fabric holder having reached a lower dead point along with vertical movement of said needle bar; and a control mechanism for selectively positioning said position restricting member in either an operating position for preventing the upward movement of said fabric holder or an evacuating position for not preventing the upward movement of said fabric holder;

wherein said control mechanism positions said position restricting member in the operating position when said fabric holder has reached the lower dead point and positions said position restricting member in the evacuating position when said fabric holder has left the lower dead point.

7. A sewing machine as claimed in claim 6, which further comprises a supporting member that is reciprocatively driven between predetermined upper and lower limit positions in synchronism with the vertical movement of said needle bar; and wherein, in the lower limit position, said supporting member defines the lower dead point of said fabric holder by supporting, from below, a predetermined portion of said fabric holder; and said control mechanism causes said position restricting member to move between the operating position and the evacuating position in response to reciprocative movement of said supporting member.

8. A sewing machine as claimed in claim 7, wherein said control mechanism comprises a mechanism for converting linear reciprocative movement of said supporting member to motion that causes said position restricting member to move between the operating position and the evacuating position.

9. A sewing machine as claimed in claim 6, wherein said control mechanism comprises a motor, and a transmission mechanism for, in response to rotation of said motor, causing said position restricting member to move between the operating position and the evacuating position.

* * * * *